US007711556B1

(12) United States Patent
Kang et al.

(10) Patent No.: US 7,711,556 B1
(45) **Date of Patent: *May 4, 2010**

(54) PSEUDO-CEPSTRAL ADAPTIVE SHORT-TERM POST-FILTERS FOR SPEECH CODERS

(75) Inventors: Hong-Goo Kang, Chatham, NJ (US); Hong Kook Kim, Chatham, NJ (US)

(73) Assignee: AT&T Intellectual Property II, L.P., New York, NY (US)

( * ) Notice: Subject to any disclaimer, the term of this patent is extended or adjusted under 35 U.S.C. 154(b) by 322 days.

This patent is subject to a terminal disclaimer.

(21) Appl. No.: 11/832,285

(22) Filed: Aug. 1, 2007

Related U.S. Application Data

(63) Continuation of application No. 10/684,852, filed on Oct. 14, 2003, now Pat. No. 7,269,553.

(51) Int. Cl.
*G10L 19/04* (2006.01)
*G10L 21/00* (2006.01)

(52) U.S. Cl. ..... 704/224; 704/219

(58) Field of Classification Search ..... None
See application file for complete search history.

(56) References Cited

OTHER PUBLICATIONS

Kim, H.K. et al., "On Approximating Line Spectral Frequencies to LPC Cepstral Coefficients", IEEE Trans. Speech Audio Processing, vol. 8, No. 2, pp. 195-199, Mar. 2000.

Kim, H.K. et al., "A Pseudo-Cepstrum Based Short-Term Postfilter", Proc. IEEE Workshop on Speech coding, Sep. 2000, pp. 99-101.

Chen, J-H et al., "Adaptive Postfiltering for Quality Enhancement of Coded Speech", IEEE Trans. Speech and Audio Processing, vol. 3, No. 1, pp. 59-71, Jan. 1995.

Tasaki, H. et al., "Spectral Postfilter Design Based on LSP Transformation", Proc. IEEE Workshop on Speech Coding, pp. 57-58, Sep. 1997.

Mustapha, A et al., "An Adaptive Post-Filtering Technique Based on the Modified Yule-Walker Filter", Proc. IEEE ECASSP '99, pp. 197=200, Mar. 1999.

Mustapha, A et al., "An Adaptive Post-Filtering Technique Based on a Least-Squares Approach", Proc. IEEE Workshop on Speech Coding, pp. 156-158, Jun. 1999.

Tarjan, R.E. et al., "Storing a Sparse Table", Communication of the ACM, vol. 22:11, pp. 606-611.

Stylianou, Y., "Concatenative Speech Synthesis Using a Harmonic Plus Boise Model", Workshop on Speech Synthesis, Jenolan Caves, NSW, Australia, Nov. 1998.

*Primary Examiner*—Talivaldis Ivars Smits

(57) ABSTRACT

Methods and systems for filtering synthesized or reconstructed speech are implemented. A filter based on a set of linear predictive coding (LPC) coefficients is constructed by transforming the LPC coefficients to the pseudo-cepstrum, a domain existing between LPC domain and the line spectral frequency (LSF) domain. The resulting filter can emphasize spectral frequencies associated with various formants, or spectral peaks, of an inverse transfer function relating to the LPC coefficients, and can de-emphasize spectral frequencies associated with various spectral minima, or spectral valleys, of the inverse transfer function relating to the LPC coefficients.

26 Claims, 9 Drawing Sheets

PSEUDO-CEPSTRAL ADAPTIVE SHORT-TERM POST-FILTERS FOR SPEECH CODERS

The present application is a continuation of U.S. patent application Ser. No. 10/684,852, filed 14 Oct. 2003, now U.S. Pat. No. 7,269,553 and claims the benefit of U.S. patent application Ser. No. 09/834,391 filed Apr. 13, 2001, now issued as U.S. Pat. No. 6,665,638, which claims the benefit of U.S. Provisional Patent Application No. 60/197,877 filed Apr. 17, 2000. The content of these patent applications is incorporated herein by reference including all references cited therein.

BACKGROUND OF THE INVENTION

1. Field of Invention

The invention relates to methods and systems that compensate for noise in digitized speech.

2. Description of Related Art

As telecommunications plays an increasingly important role in modern life, the need to provide clear and intelligible voice channels increases commensurately. However, providing clear, noise-free and intelligible voice channels has traditionally required high-bit-rate communication links, which can be expensive. While lowering the bit-rate of a voice channel can reduce costs, low-bit-rates tend to introduce side-effects, such as quantization noise, which can reduce the clarity and/or intelligibility of voice signals. Unfortunately, removing noise in a voice signal generated by low-bit-rate channels can require excessive processing power and distort the voice signal. Accordingly, there is a need for new technology to provide better voice channels that reduce processing power requirements while minimizing distortion.

SUMMARY OF THE INVENTION

The invention provides the short-term post-filtering methods and systems for digital voice communications. Generally, post-filtering improves the perceptual quality of the synthesized signal and is widely used in current low-bit-rate speech coders. The common post-filter consists of three filters: a long-term post-filter, a short-term post-filter and a tilt compensation filter. The long-term post filter generally relates to improving perceptual quality of speech by emphasizing pitch periodicity. The short-term post filter, adaptively constructed from LPC coefficients, removes perceptible noise from synthesized or reconstructed speech by de-emphasizing speech frequency components related to spectral valleys, or local minima. The tilt compensation filter is required to compensate for spectral tilt caused by the short-term post-filter.

In various exemplary embodiments, a set of linear predictive coding (LPC) coefficients is used to derive a second set of LPC coefficients having a reduced order, which can subsequently be used to derive a low-order short-term post-filter based on the pseudo-cepstrum. The low-order short-term post-filter can then adaptively remove perceptible noise from synthesized or reconstructed speech by emphasizing speech frequency components related to the formants of the LPC coefficients and de-emphasizing speech frequency components related to the spectral valleys of the LPC coefficients. The short-term post-filter can also compensate for spectral distortion such as spectral tilt and minimize phase distortion.

Other features and advantages of the present invention will be described below or will become apparent from the accompanying drawings and from the detailed description which follows.

BRIEF DESCRIPTION OF THE DRAWINGS

The invention is described in detail with regard to the following figures, wherein like numbers reference like elements, and wherein.

DETAILED DESCRIPTION OF PREFERRED EMBODIMENTS

There is obviously an economic advantage in making telecommunication channels operate as inexpensively as possible. For digital communication channels such as modern long-distance phone lines and cellular phone links, there is a direct correlation to the cost of a voice communication channel and the number of bits per second the communication-channel requires.

Traditionally, high-quality digital voice channels required high-bit-rates. However, by efficiently compressing a voice signal before transmission, bit-rates can be lowered without noticeable degradation of the clarity and/or intelligibility of the received voice signals. One efficient compression technique is the linear predictive coding (LPC) technique, which compresses human voices based on a model analogous to the human vocal system. That is, for a given time segment, or frame, of sampled speech, an LPC coding device will break the sampled speech into an excitation, or residue, portion that models the human larynx, and a corresponding LPC transfer function that models the human vocal tract. Fortunately, the quality of speech reconstruction can be dramatically improved while simultaneously reducing the processing complexity by modeling the vocal excitation signals with structured vector codebooks. This approach is typically referred to as the excited linear prediction (CELP) method, and it is the most common method of the current standard speech coders.

The general form of the LPC transfer function is shown in Eqs. (1) and (2):

$$A_M(z) = 1 + \sum_{i=1}^{M} a_{M,i} z^{-i}; \quad \text{or} \tag{1}$$

$$A_M(z) = 1 + a_{M,1} z^{-1} + a_{M,2} z^{-2} + a_{M,3} z^{-3} \ldots a_{M,M} z^{-M} \tag{2}$$

where $a_{M,i}$ is the i-th LPC predictor coefficient, M is the order of the LPC transfer function, and ($a_{M,1}$, $a_{M,2}$, $a_{M,3}$, . . . $a_{M,M}$) are the LPC coefficients of the transfer function.

Figure 1:
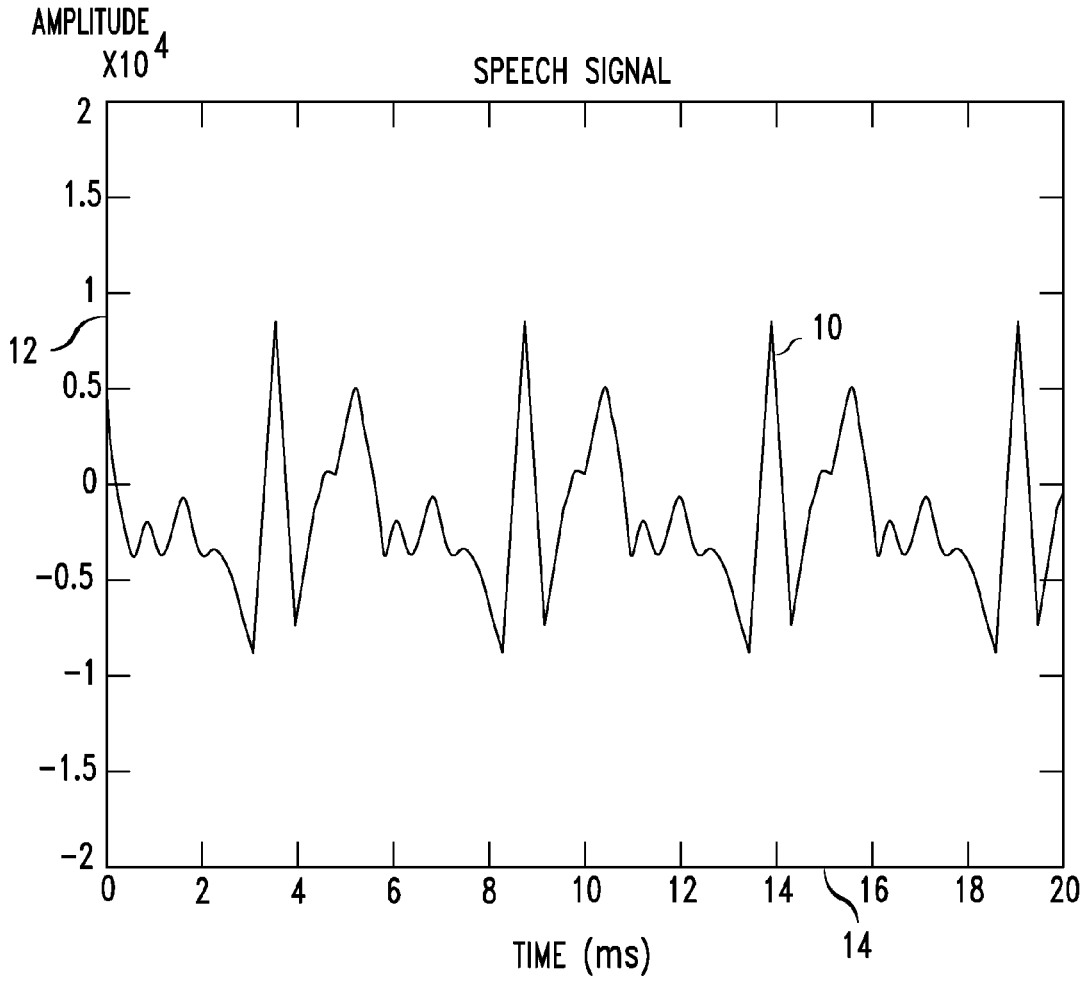
FIG. 1 is a representation of an exemplary human voice signal.
Figure 2:
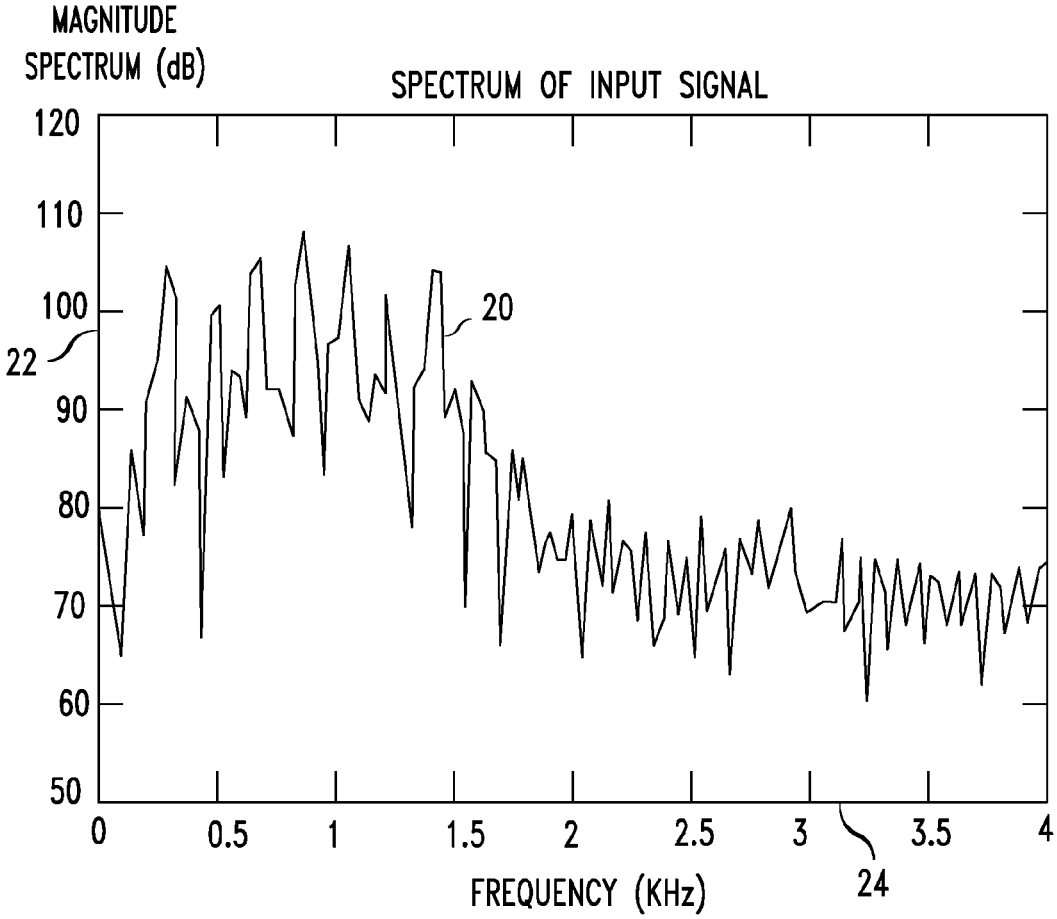
FIG. 2 is a representation of an exemplary logarithmic magnitude spectrum based on the human voice signal of FIG. 1.

FIG. 1 shows an exemplary speech signal s(n) 10. As shown in FIG. 1, an exemplary speech signal 10 is plotted against an amplitude axis 12 and along a time axis 14. FIG. 2 shows an exemplary logarithmic magnitude spectrum 20×log10|S(z)| of the speech signal s(n) of FIG. 1. The exemplary spectrum curve 20 is plotted against an amplitude axis 22 and along a frequency axis 24.

Figure 3:
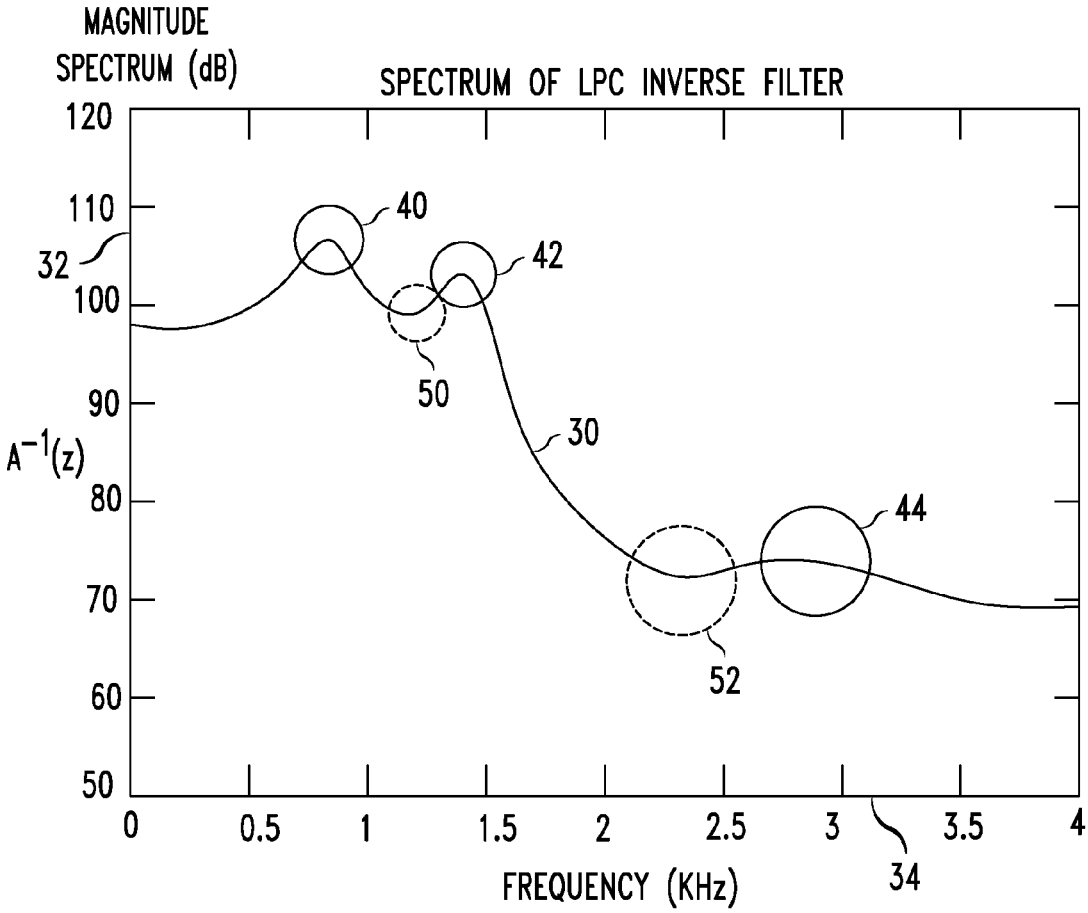
FIG. 3 is a is a representation of an exemplary LPC inverse transfer function based on the voice signal of FIG. 1.

FIG. 3 shows a graphic representation of an exemplary LPC inverse transfer function A-1(*z*) 30 derived from the speech signal 10 of FIG. 1. As shown in FIG. 3, the inverse transfer function 30 is plotted against an amplitude axis 32 and along a frequency axis 34 and has three local maxima, or formants, 40, 42 and 44 and two local minima, or spectral valleys, 50 and 52. The particular shape of the inverse transfer function 30 is related to the roots of transfer function A(z). That is, the formants are located coincident with the roots of A(z). The relationships between LPC transfer functions, their graphic representations and subsequent effects are well known and are described in Chen, J. and Gersho, A, "Adaptive Postfiltering for Quality Enhancement of Coded Speech", IEEE Transactions on Speech and Audio Processing, Vol. 3, No. 1 (January 1995) incorporated herein by reference in its entirety.

Figure 4:
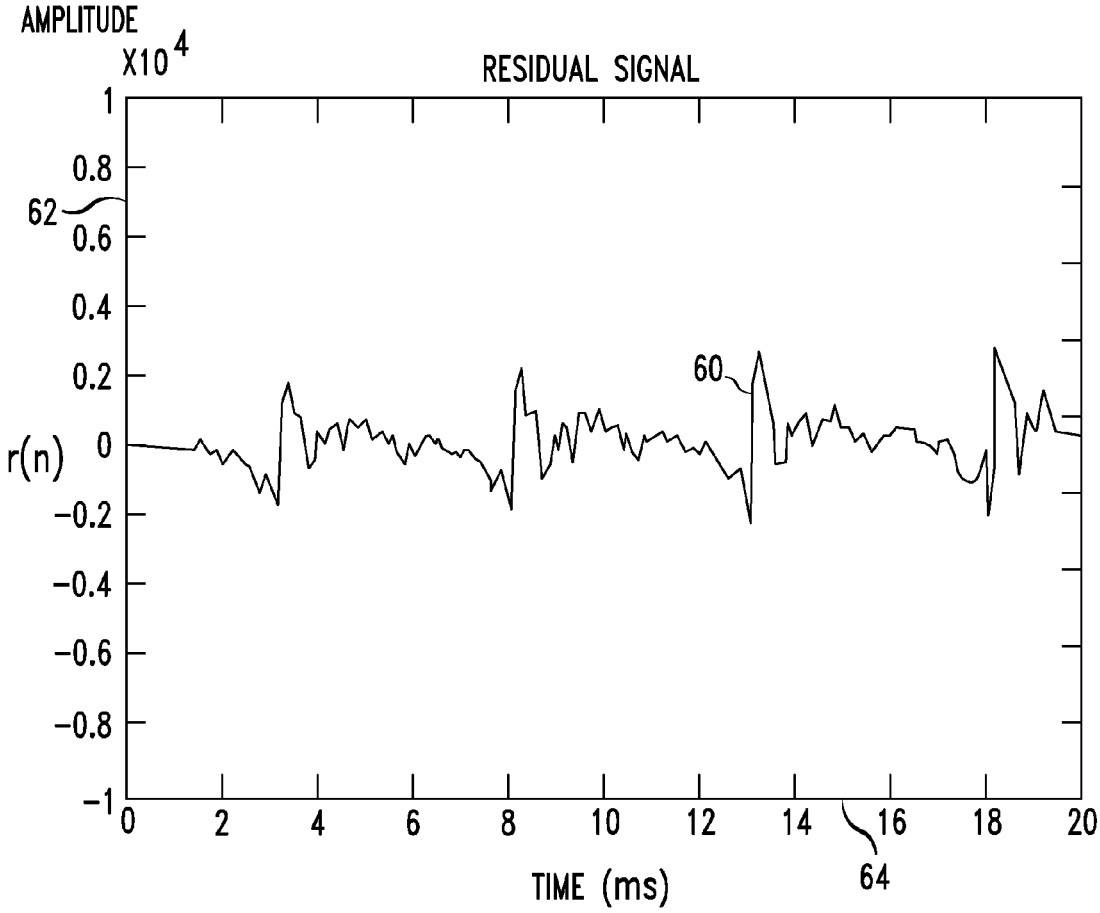
FIG. 4 is a representation of an exemplary residue signal based on the voice signal of FIG. 1.
Figure 5:
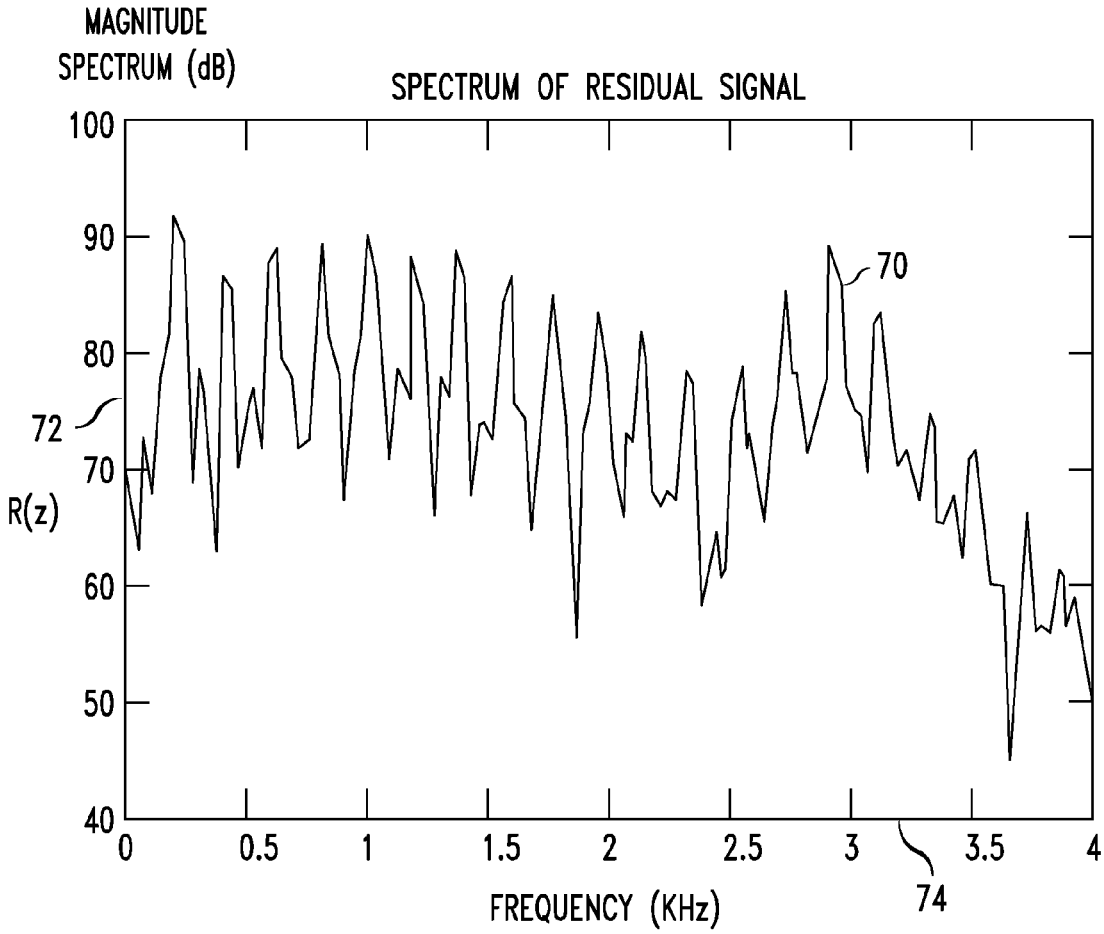
FIG. 5 is a representation of an exemplary logarithmic magnitude spectrum of the residual signal of FIG. 4.

FIG. 4 shows a representation of an LPC residue r(n) 60 of the speech signal s(n) of FIG. 1 plotted against an amplitude axis 62 and along a time axis 64. As discussed above, the residue 60 models the human larynx and compliments the LPC transfer function A(z) such that, when the signal residue 60 is passed through a filter having the inverse transfer function A-1(*z*) 30, a signal s'(n) will be synthesized, which will approximate the original speech signal s(n). FIG. 5 shows an exemplary logarithmic magnitude spectrum 20×log10|R(z)| of the residual signal r(n) 70 of FIG. 4.

The exemplary residual spectrum curve 70 is plotted against an amplitude axis 72 and along a frequency axis 74. As discussed above, the bit-rates of communication channels can be lowered with little noise and/or distortion by applying an LPC compression technique to a speech signal, passing the LPC coefficients and residue to a receiver, and reconstructing/synthesizing the speech signal at a receiver. However, there is a practical limit to LPC compression; and as bit-rates for LPC channels further drop, quantization noise and other distortions become increasingly noticeable until the received voice signal becomes unacceptable.

To remove the resulting deleterious noise, a post-filtering step can be added to the synthesized speech process. Because of the nature of human perception, it can be desirable that such a post-filtering step selectively enhance the frequency regions near the formants and selectively attenuate the frequency regions near the spectral valley regions of a given LPC inverse transfer function A-1(*z*). Furthermore, because the formants and spectral valleys can vary over time, it becomes advantageous to adaptively vary the post-filtering step to accommodate the varying formants and spectral valleys of A-1(*z*).

Unfortunately, conventional domains relating to linear predictive coding (LPC) coefficients, log area ratio (LAR) coefficients, line spectrum frequency (LSF) coefficients as well as any other known coefficients are not well-suited to creating post-filters. However, by mapping LPC parameters into the pseudo-cepstrum, a domain conceptually located between the LPC and LSF domains, a set of pseudo-cepstral coefficients is produced that can more efficiently and effectively form adaptive post-filters capable of removing perceptible noise with minimal distortion. One advantage of using the pseudo-cepstrum is that low-order filters can be easily produced that can perform as well as filters requiring twice as many coefficients. Still another advantage to using the pseudo-cepstrum is that spectral correction techniques such tilt-filters generally present in other post-filters can be eliminated.

Figure 6:
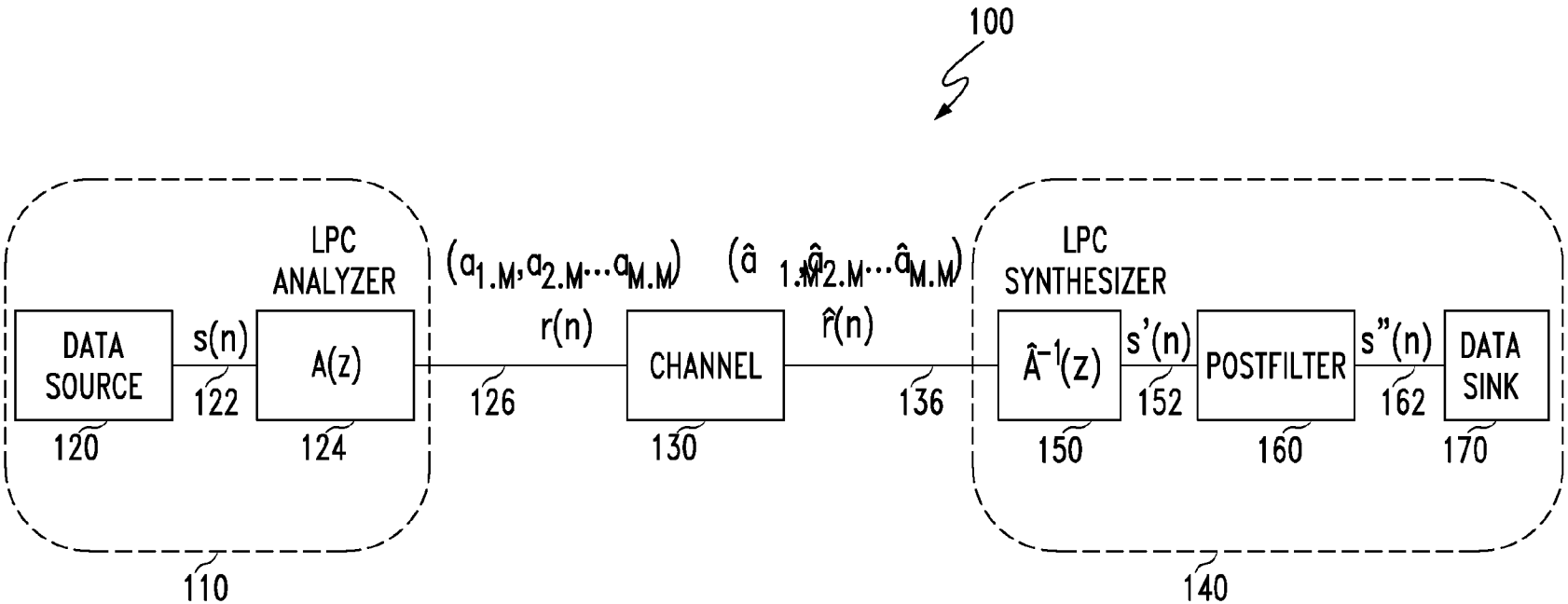
FIG. 6 is a block diagram of an exemplary communication system.

FIG. 6 shows an exemplary block diagram of a communication system 100. The system 100 includes a transmitter 110, a communication channel 130 and a receiver 140. The transmitter 110 has a data source 120 and a linear predictive coding (LPC) analyzer 124, and the receiver 140 has a LPC synthesizer 150, a post-filter 160 and a data sink 170. The receiver 110 provides voice information r(n) to the communication channel 130 that, in turn, provides the channeled voice information r̂(n) to the receiver 140.

In operation, the data source 120 provides voice signals s(n) to the LPC analyzer 124 via link 122. In various exemplary embodiments, the data source 120 can be any one of a number of different types of sources such as a person speaking into a microphone, a computer generating synthesized speech, a storage device such as magnetic tape, a disk drive, an optical medium such as a compact disk, or any known or later developed combination of software and hardware of capable of generating, relaying or recalling from storage any information capable of being transmitted to the LPC analyzer. It should be further appreciated that the speech signals can be any form of speech, such as speech produced by a human, mechanical speech or information representing speech produced by a speech synthesizer or any other form of signal or information that can represent speech. However, for the purpose of discussion below, the data source 120 will be assumed to be a person speaking into the receiver of a cellular telephone.

As the LPC analyzer 124 receives speech signals from the data source 120 via link 122, it divides the speech signals into individual time frames. For example, the LPC analyzer 124 can receive a continuous speech signal and divide the continuous speech into contiguous frames of 20 ms each. The LPC analyzer 124 can then perform an LPC analysis on each speech frame to generate LPC coefficients and residue information pertaining to each frame that can be exported to the communication channel 130 via link 126. The exemplary LPC analyzer 124 is a dedicated signal processor with an analog-to-digital converter and other peripheral hardware. However, the LPC analyzer 124 can alternatively be a digital signal processor or micro-controller with various peripheral hardware, a custom application specific integrated circuit (ASIC), discrete electronic circuits or any other known or later developed device capable of receiving voice signals from the data source 120 and providing LPC coefficients and residue information to the communication channel 130.

Unfortunately, the LPC coefficients (aM.1, aM.2, aM.3, . . . aM.M) cannot be quantized directly due to stability problems. Instead, the LPC coefficients first must be converted to another form of information. For example, a set of LPC coefficients can be converted to a set of reflection coefficients, log area ratio (LAR) coefficients, line spectrum frequency (LSF) coefficients or coefficients of some other domain, and converted into the LPC coefficients in the decoder. The communication channel 130 receives the quantized LPC coefficients (aM.1, aM.2, aM.3, . . . aM.M) and residue information r(n) via link 126 and provides the channeled LPC coefficients (âM.1, âM.2, âM.3, . . . âM.M) and channeled residue information r̂(n) to the receiver 140 via link 136.

Generally, it should be appreciated that the residue information r(n) and the channeled residue information r̂(n) should ideally be identical. However, when a channel error occurs, the residue information r(n) and the channeled residue information r̂(n) can vary in the absence of error correction. However, it should be assumed for the purpose of the following embodiments that the residue information r(n) and the channeled residue information are identical.

The exemplary communication channel 130 is a wireless link over a cellular telephone network. However, the communication channel 130 can alternatively be a hardwired link such as a telephony T1 or E1 line, an optical link, other wireless/radio links, a sonic link, or any other known or later developed communications device or system capable of receiving LPC coefficients and residue information from the transmitter 110 and providing this data to the receiver 140.

The LPC synthesizer 150 receives LPC coefficients and residue information for various speech frames from the communication channel 130 via link 136. As speech frames are received, the LPC synthesizer 150 constructs a filter/process $\hat{A}$-1($z$) using the LPC coefficients for each frame. The LPC synthesizer 150 then processes the respective residue using the filter to synthesize a speech signal s'(n), which is an approximation of the original speech s(n), and provides each frame of synthesized speech to the post-filter 160 via link 152.

The exemplary LPC synthesizer 150 is a dedicated signal processor with peripheral hardware. However, the LPC synthesizer 150 can be any device capable of receiving LPC coefficients and residue information from a communication channel and providing synthesized speech to a post-filter, such as a digital signal processor or micro-controller with various peripheral hardware, a custom application specific integrated circuit (ASIC), discrete electronic circuits and the like.

The post-filter 160 can receive synthesized speech frames from the LPC synthesizer 150 via link 152 and can further receive LPC coefficients either from the LPC synthesizer 150, directly from the communication channel 130 or from any other conduit capable of providing LPC coefficients. The post-filter 160 then constructs or modifies various internal filters, processes and coefficients within the post-filter 160, filters the synthesized speech frames and provides the filtered speech frames s'(n) to the data sink 170.

The exemplary post-filter 160 is a dedicated signal processor with peripheral hardware including a digital-to-analog converter. However, the post-filter 160 can be any device capable of receiving LPC coefficients and synthesized speech, constructing or modifying various filters, process and coefficients, filtering the synthesized speech using the various filters, processes and coefficients and providing filtered speech to the data sink 170, such as a digital signal processor or micro-controller with various peripheral hardware, a custom application specific integrated circuit (ASIC), discrete electronic circuits and the like.

The data sink 170 receives data from the post-filter 160 via link 162. The exemplary data sink 170 is an electronic circuit having an analog-to-digital converter, an amplifier and microphone capable of transforming electronic signals into mechanical/acoustical signals. However, the data sink 170 alternatively can be any combination of hardware and software capable of receiving speech data, such as a transponder, a computer with a storage system or any other known or later developed device or system capable of receiving, relaying, storing, sensing or perceiving signals provided by the post-filter 160.

Figure 7:
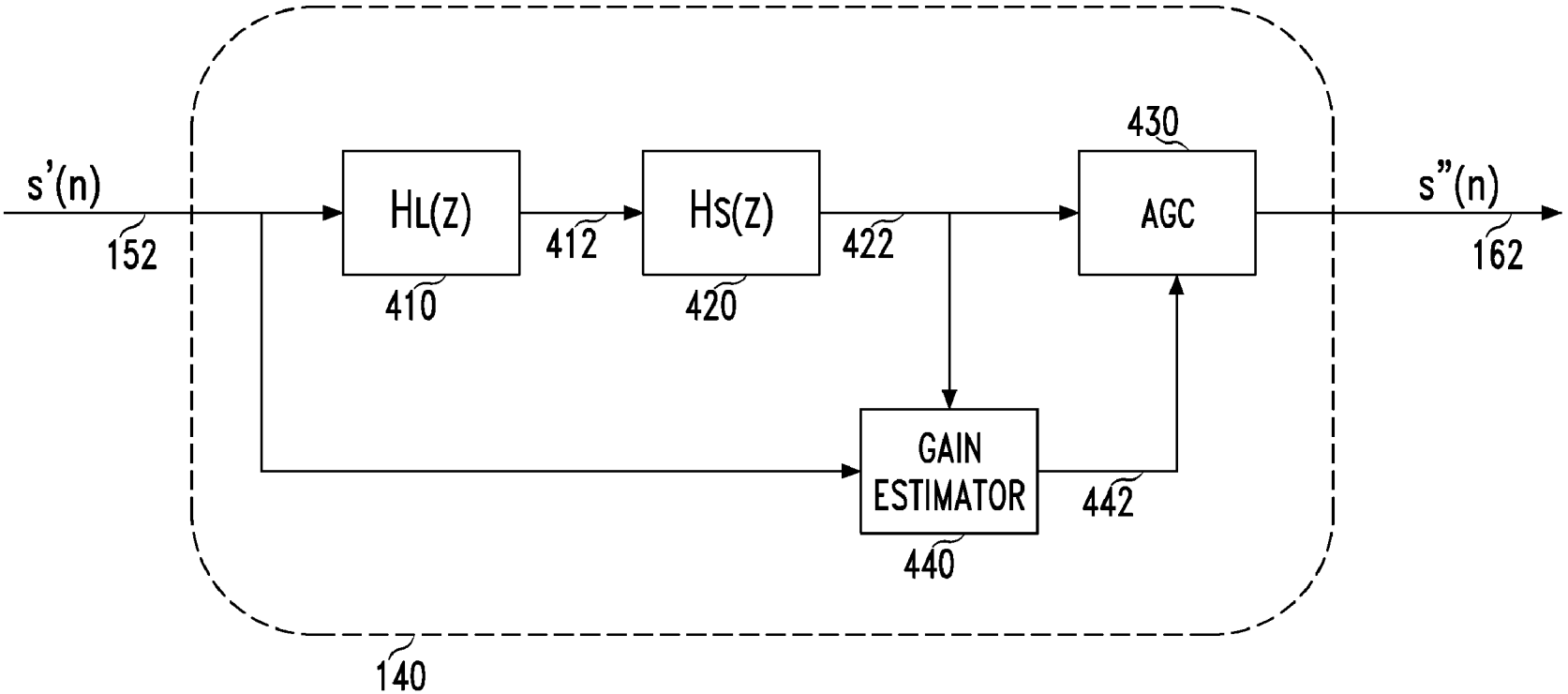
FIG. 7 is a block diagram of an exemplary embodiment of the post-filter of FIG. 6.

FIG. 7 is a block diagram of an exemplary post-filter 140 that can receive synthesized speech data, LPC coefficients and residue information via link 152 and provide filtered speech data to link 162. As shown in FIG. 7, the exemplary post-filter has a long-term filter HL(z) 410, a short-term filter HS(z) 420, an automatic gain control (AGC) 430 and a gain estimator 440. The long-term filter 410 receives frames of synthesized speech, performs a first filtering operation on the frames of synthesized speech, then passes the filtered speech to short-term filter 420, which can perform a second filtering operation. The short-term filter 420 can then pass its filtered speech data to the AGC 430, which scales the filtered speech to correct for gain mismatch caused by the filters 410 and 420. After the AGC 430 compensates for gain error, the AGC can provide the scaled speech data to link 162.

In operation, the long-term filter 410 receives frames of synthesized speech and respective residue information and subsequently filters the speech frames using the residual information. Generally, the residue information can be used to compute the pitch delay and gain of the long-term filter 410 such that the long-term filter 410 can improve the perceptual quality of the synthesized speech by emphasizing pitch periodicity, especially for voiced frames. The processes and functions of long-term filters are well known in the art and are described in Chen, J. and Gersho, A, "Adaptive Postfiltering for Quality Enhancement of Coded Speech", IEEE Transactions on Speech and Audio Processing, Vol. 3, No. 1, pp. 63-66 (January 1995). After the long-term filter 410 performs its filtering processes, it provides the filtered data to the short-term filter 420 via link 412.

The exemplary long-term filter 410 is implemented using a digital signal processor operating dedicated firmware and having various peripheral devices to accommodate input/output functions. However, the long-term filter 410 can alternatively be implemented using a digital signal processor, a micro-controller, an ASIC or other specialized electronic hardware or any other known or later developed device that can receive frames of speech data, perform long-term filtering operations such as emphasizing pitch periodicity, and provide the filtered data to the short-term filter 420.

The short-term filter 420 receives frames of filtered synthesized speech data from the long-term filter 410 and further receives the LPC coefficients either from the long-term filter 410, directly from the communication channel 120 via link 152, or from some other link capable of providing LPC coefficients.

In operation, the short-term filter 420 can perform a filtering operation based on the LPC coefficients to improve the perceptual quality of the synthesized speech. Referring to the LPC inverse transfer function 30 of FIG. 3, it should be appreciated that the human ear is particularly sensitive to noise in the spectral valley regions 50 and 52, but relatively insensitive to noise at the formants 40, 42 and 44. Accordingly, for any transfer function having formants and spectral valleys, it can be desirable to emphasize frequencies at or near the formants while de-emphasizing frequencies at or near the spectral valleys.

As discussed above, synthesizing short-term filters using conventional techniques can cause spectral distortions that can require a spectral correction filter such as a tilt filter. However, by mapping LPC coefficients to the pseudo-cepstrum, a domain between the LPC and the LSF domains, stable short-term post-filters can be easily synthesized that do not require an additional tilt filter.

Conversion from the LPC domain to the pseudo-cepstrum can start by defining two polynomials, the symmetric polynomial of Eq. (3) and the anti-symmetric polynomial of Eq. (4):

$$P_M(z) = A_M(z) + z^{-(M+1)}A_M(z^{-1}) = \sum_{k=0}^{M+1} p_{M,k} z^{-k} \tag{3}$$

$$Q_M(z) = A_M(z) - z^{-(M+1)}A_M(z^{-1}) = \sum_{k=0}^{M+1} q_{M,k} z^{-k} \tag{4}$$

where $A_M(z)=1+a_{M.1}z^{-1}+a_{M.2}z^{-2}a_{M.3}z^{-3} \ldots a_{M.M}z^{-m}$ from Eq. (2) above, $a_i$ is the i-th LPC coefficient and the coefficients $p_0=q_0=1$. Transforming to pseudo-cepstrum is then defined by Eq. (5):

$$\log(P_M(z)Q_M(z)) = -2\sum_{n=0}^{\infty} c'_{M.n}z^{-n} \tag{5}$$

Given the relationship between LPC coefficients, $a_{M.i}$, and LPC cepstral coefficients, $c_{M.i}$, is defined by:

$$\log(A_M(z)) = -\sum_{n=1}^{\infty} c_{M.n}z^{-n} \tag{6}$$

the cepstral difference $C_D(z)$ between cepstral coefficients, $c_{M.n}$, and the pseudo-cepstral coefficients, $c'_{M.n}$, can be written as:

$$C_D(z) = -\sum_{n=1}^{\infty} (c_{M.n} - (c'_M)_n)z^{-n}; \text{ or} \tag{7}$$

$$C_D(z)=\tfrac{1}{2}\log(P_M(z)Q_M(z))-\log(A_M(z)); \text{ or} \tag{8}$$

$$C_D(z)=\tfrac{1}{2}\log(1-R^2_M(z)) \tag{9}$$

where $R_M(z)=(z^{-(M+1)}A_M(z^{-1}))/A_M(z)$. Details of the pseudo-cepstrum and transformation from the LPC domain can be found in at least Kim, H., Choi, S. and Lee, H., "On Approximating Line Spectral Frequencies to LPC Cepstral Coefficients", *IEEE Transactions on Speech and Audio Processing*, Vol. 8, No. 2, pp. 195-199, (March 2000) herein incorporated by reference in its entirety.

From Eqs. (7)-(9), $1-R^2_M(z)$ can be rewritten as Eq. (10):

$$1-R^2_M(z)=(P_M(z)Q_M(z))/A^2_M(z) \tag{10}$$

where $R^2_M(z)=1$ when $z=\pm1$ and $\exp(j\omega_{M.i})$ for i=1, 2, . . . M, where $\omega_{M.i}$ is the i-th LSF coefficient of order M. If the roots of $P_M(z)$, $Q_M(z)$ and $A^2_M(z)$ are inside the unit circle, a generalized short-term post-filter can be realized having the form:

$$H_S(z)=(P_M(z/\alpha_1)Q_M(z/\alpha_2))/A^2_M(z/\beta) \tag{11}$$

where $\alpha_1$, $\alpha_2$, and $\beta$ are control parameters and $0<\alpha_1$, $0<\alpha_2$, and $\beta<1$, or $$H_S(z)\approx(P_M(z/\alpha_1)Q_M(z/\alpha_2))/A_M(z/2\beta) \tag{12}$$

when $0<\alpha_1$, $0<\alpha_2$, and $\beta<0.5$.

A first benefit of short-term post-filters based on Eq. (12) is that they automatically compensate for spectral tilt and do not require tilt-filters. Another benefit of short-term post-filters based on Eq. (12) is that they will produce negligible phase distortion of speech signals if the values of the control parameters $\alpha_l$, $\alpha_2$, and $\beta$ are selected such that $\alpha_1+\alpha_2=2\beta$.

The values of control parameters $\alpha$1, $\alpha$2, and $\beta$ can be determined experimentally or can be set according to the communication environment. Generally, the values of the control parameters will vary with the bit-rate of a communication system, the type of speech coder used, or a function of other factors such as effects of various noise sources. For example, for a high-bit-rate communication system with low quantization noise, a weak post-filter will provide optimal performance, i.e., a low value of $\beta$ is preferable. However, as the bit-rate drops or other noise sources increase, $\beta$ will increase commensurately.

While short-term post-filters can be synthesized according to Eq. (12), it can be advantageous to synthesize short-term post-filters having reduced order. For example, for an LPC transfer function of order ten, a short-term pseudo-cepstral filter of order ten can be synthesized or alternatively short-term pseudo-cepstral filters having orders less than ten can also be synthesized according to Eq. (13):

$$H^m_S(z)\approx(P_m(z/\alpha_1)Q_m(z/\alpha_2))/A_M(z/2\beta) \tag{13}$$

where $1\leqq m\leqq M$, M is the order of the LPC transfer function and m is the desired order of the synthesized short-term filter and where $P_m(z/\alpha_i)$ and $Q_m(z/\alpha_2)$ can be defined by Eqs (14) and (15):

$$P_m(z)=A_m(z)+z^{-(m+1)}A_m(z^{-1}); \text{ and} \tag{14}$$

$$Q_m(z)=A_m(z)-z^{-m+1)}A_m(z^{-1}). \tag{15}$$

The LPC coefficients of order m can be recursively generated through a step-down process described by Eq. (16):

$$a_{l-i.i}=(a_{l.i}-k_l a_{l.l-i})/(1-k^2_l) \tag{16}$$

where l=M, M−1, . . . m+1; i=1, 2 . . . l−1; $k_l=a_{1.1}$ and $a_{l-1.0}=1$. Details of the step-down procedure can be found in at least Markel, J. and Gray, A., *Linear Prediction of Speech pp.* 95-97 (New York: Springer-Verlag 1976) herein incorporated by reference in its entirety. It should be appreciated that, as m decreases to lower orders, spectral tilt of the LPC transfer function can increase. However, because of the nature of the pseudo-cepstrum, short-term filters generated according to Eqs. (13)-(16) will not require tilt filters or other equivalent spectral correction.

The exemplary short-term filter 420 is implemented using a digital signal processor operating dedicated firmware and having various peripheral devices to accommodate input/output functions. However, the short-term filter 420 can alternatively be implemented using a digital signal processor, a micro-controller, an ASIC or other specialized electronic hardware or any other known or later developed device that can receive frames of speech data, filter the speech data to emphasis and de-emphasis different spectral frequencies based on an LPC inverse transfer function and provide the filtered data to the AGC 430.

The AGC 430 receives the filtered speech via link 422 and scales the filtered speech to correct for gain errors caused by the filters 410 and 420. For example, given a frame of synthesized speech having an overall power level of ten decibels, if the filtered speech produced by the filters 410 and 420 has a power level of six decibels, the AGC 430 will increase the level of the filtered data by four decibels.

In operation, the ACG 430 adjusts its gain level based on information provided by the gain estimator 440 via link 442 and provides the scaled speech to the link 162. In various exemplary embodiments, the gain estimator 440 determines the gain mismatch produced by the filters 410 and 420 by measuring the power of each frame of synthesized speech at the link 152, measuring the power of each frame of filtered speech at the link 422 and taking the difference of the power levels.

Figure 8:
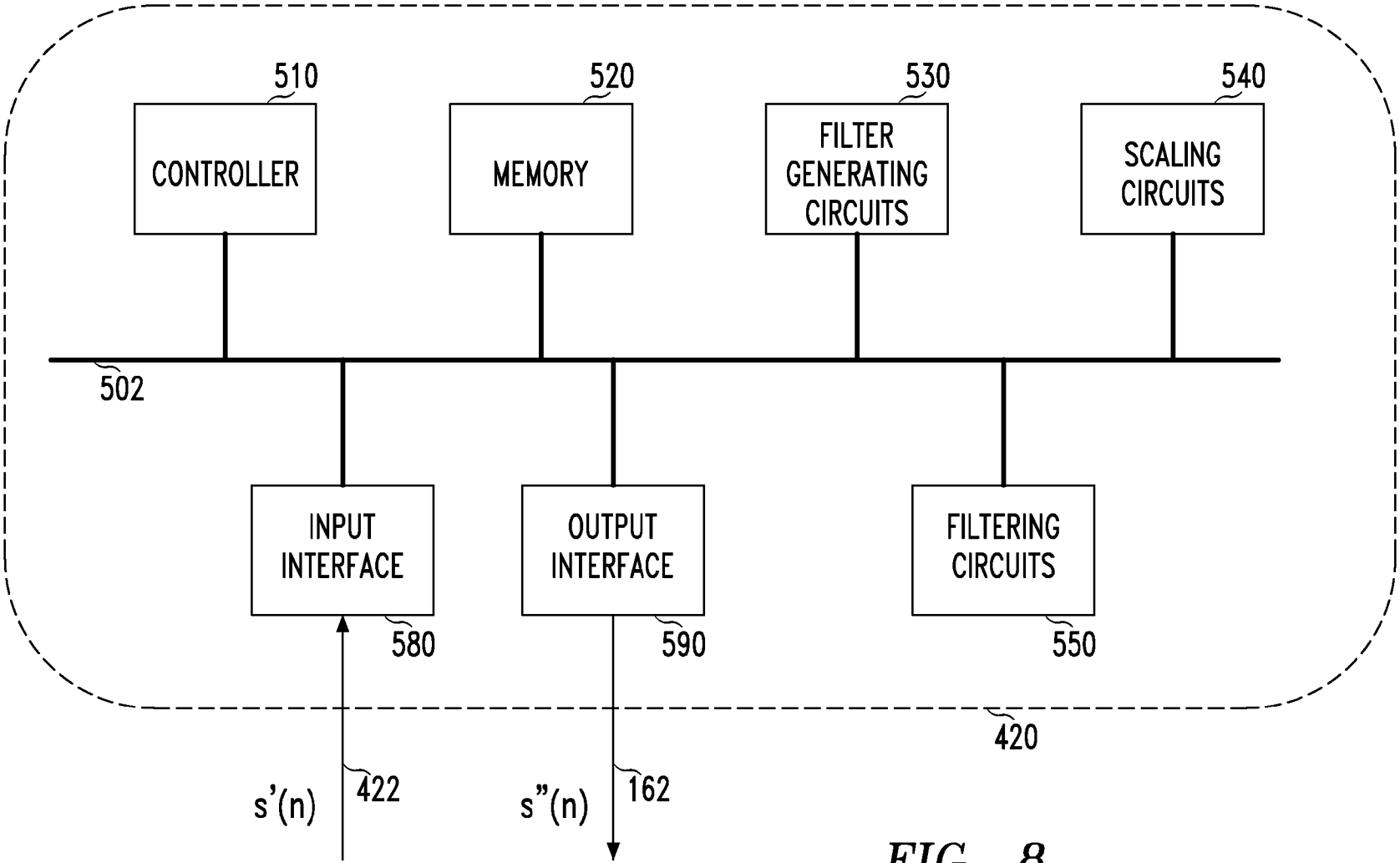
FIG. 8 is a block diagram of an exemplary embodiment of the short-term filter of FIG. 7.

FIG. 8 is a block diagram of an exemplary short-term filter 420. The short-term filter 420 has a controller 510, a memory 520, filter generating circuits 530, scaling circuits 540, filtering circuits 550, an input interface 580 and output interface 590. The various components 510-590 are linked together via control/data bus 502. The links 422 and 162 are connected to the input-interface 580 and output-interface 590, respectively.

As frames of synthesized speech and respective LPC coefficients are presented to the input interface 580, the controller 510 can transfer the synthesized speech and respective LPC coefficients to the memory 520. The memory 520 can store the synthesized speech and respective LPC coefficients and other data generated by the short-term filter 420 during speech processing.

In various exemplary embodiments, the filter generating circuits 530, under control of the controller 510, can receive the LPC coefficients and determine the pseudo-cepstral coefficients for a short-term filter based on Eq. (12) above to synthesize a short-term filter of the same order as that of the LPC transfer function described by the LPC coefficients.

In other various exemplary embodiments, the filter generating circuits 530 can determine the pseudo-cepstral coefficients for a short-term filter based on Eq. (13)-(16) above to synthesize a short-term filter having a lower order than that of the LPC transfer function. For example, given an LPC transfer function of order ten, i.e., $A10(z)=1+a10.1\ z-1+a10.2\ z-2+a10.3\ z-3 \ldots a10.10\ z-10$, Eq. (16) can be used to reduce the order to six, i.e., $A6(z)=1+a6.1\ z-1+a6.2\ z-2+a6.3\ z-3 \ldots a6.6\ z-6$. Subsequently, $P6(z)$ and $Q6(z)$ can be determined using Eqs. (14) and (15), and $H6S(z)$ can then be calculated using Eq. (13). Once the desired short-term filter coefficients are synthesized, the filter generating circuits 530, under control of the controller 510, can transfer the filter coefficients to the scaling circuits 540.

The scaling circuits 540 can receive the short-term filter coefficients, determine the values of control parameters $\alpha 1$, $\alpha 2$, and $\beta$ of either Eqs. (12) or (13), scale the short-term filter coefficients accordingly and provide the scaled filter coefficients to the filtering circuits 550. As discussed above, control parameters $\alpha 1$, $\alpha 2$, and $\beta$ can be determined experimentally or can be set based on various aspects of a communication environment, such as the system bit-rate, the type of speech coder used, or based on other factors such as effects of various noise sources. While control parameters $\alpha 1$, $\alpha 2$, and $\beta$ can be adjusted independently, as discussed above, short-term post-filters synthesized using Eqs. (12) or (13) will produce negligible phase distortion if the values of control parameters $\alpha 1$, $\alpha 2$, and $\beta$ are selected such that $\alpha 1+\alpha 2=2\beta$. Once the filter coefficients of the short-term filter are scaled, the scaling circuits 540, under control of the controller 510, transfer the scaled short-term filter to the filtering circuits 550.

The filtering circuits 550, under control of the controller 510, can receive the frame of speech stored in the memory 520 and subsequently filter the speech data in each frame. As each frame of speech data is filtered, the filtering circuits 550, under control of the controller 510, can export the filtered speech to the link 162 through the output interface 590.

Figure 9:
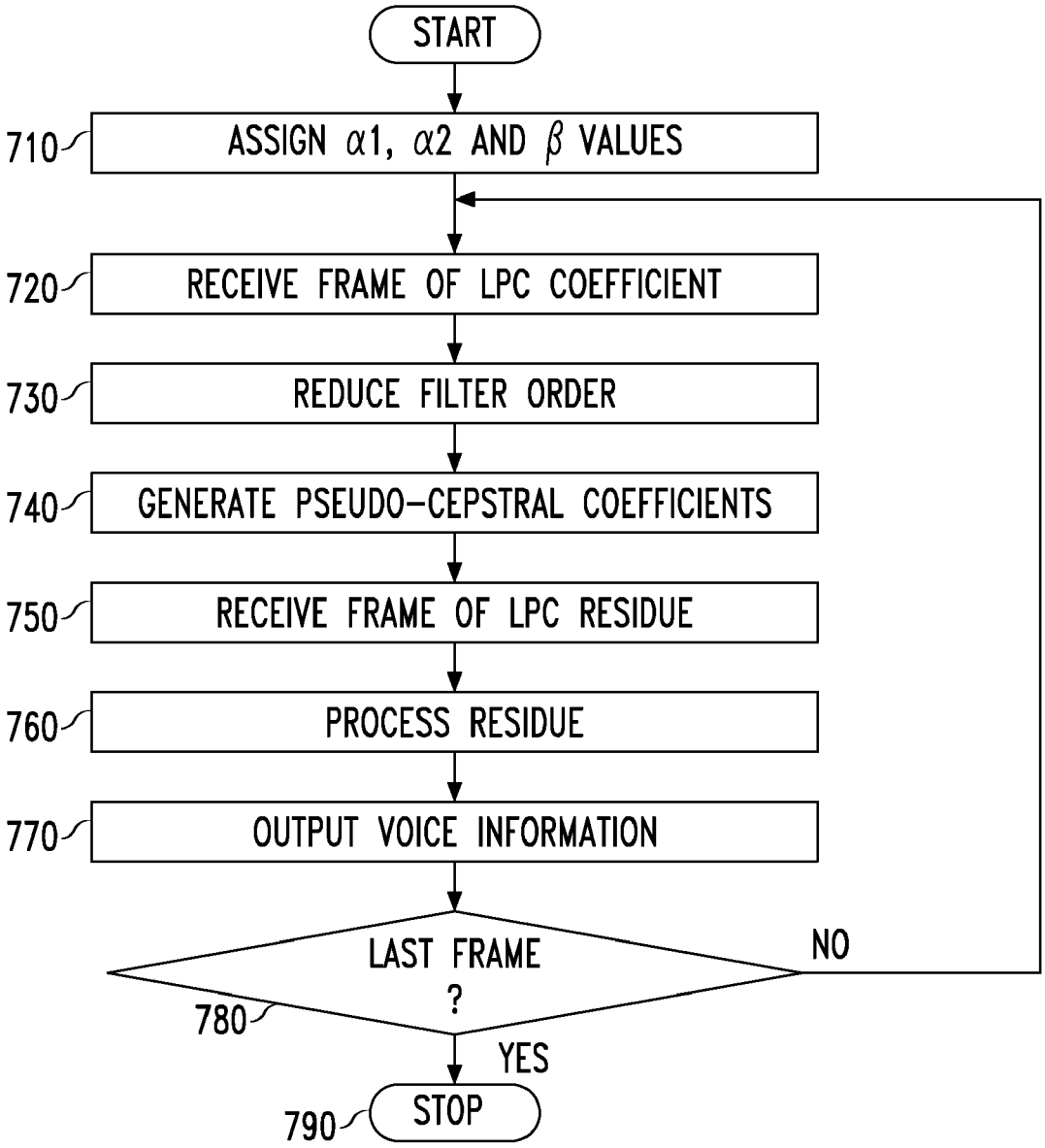
FIG. 9 is a flowchart outlining an exemplary operation of a process for filtering voice information.

FIG. 9 is a flowchart outlining an exemplary method for adaptively forming short-term filters and filtering speech data using the short-term filters. The operation starts in step 710 where the control parameters $\alpha 1$, $\alpha 2$, and $\beta$ are determined. As discussed above, control parameters $\alpha 1$, $\alpha 2$, and $\beta$ can be determined independently, but short-term post-filters will produce negligible phase distortion if the values of control parameters $\alpha 1$, $\alpha 2$, and $\beta$ are selected such that $\alpha 1+\alpha 2=2\beta$. Next, in step 720, the LPC coefficients for a frame of speech are received. Control continues to step 730.

In step 730, a determination is made whether to reduce the order of the LPC transfer function described by the LPC coefficients received in step 720. If the order of the LPC transfer function is to be reduced, control continues to step 740; otherwise control jumps to step 750. In step 740, the order of the LPC transfer function is reduced using Eq. (16) above to generate a reduced set of LPC coefficients and control continues to step 750.

In step 750, the pseudo-cepstral coefficients for a short-term filter are generated. In various exemplary embodiments, the pseudo-cepstral coefficients are generated using the LPC coefficients received in step 720 and Eq. (12) above. In other various exemplary embodiments, the pseudo-cepstral coefficients are generated using the reduced set of LPC coefficients generated in step 740 and Eq. (13) above. Once the pseudo-cepstral coefficients are generated, control continues to step 760.

In step 760, a frame of speech related to the LPC coefficients of step 720 is received. Next, in step 770, a short-term filtering operation is performed on the received frame of speech using the filter coefficients generated in step 750. Control continues to step 780.

In step 780, a long-term filtering operation is performed to improve the perceptual quality of the synthesized speech by emphasizing pitch periodicity. Next, in step 790, a gain control operation is performed to adjust for gain mismatch produced by the filtering steps of 760 and 770. Then, in step 800, the filtered and scaled speech data produced in steps 720-780 is provided to a data sink such as a speaker, a storage device and the like. Control continues to step 810.

In step 810, a determination is made as to whether any more frames of speech data are to be filtered and scaled. If there are more speech frames to be filtered, control jumps back to step 720 where the next frame of LPC coefficients is received. Otherwise, control continues to step 820 where the process stops.

In the exemplary embodiment shown in FIG. 6, the transmitter 110 and receiver 140 are implemented using programmed digital signal processors equipped with a peripheral devices. However, the transmitter 110 and receiver 140 can also be implemented on a general or special purpose computer, a programmed microprocessor or micro-controller and peripheral integrated circuit elements, an ASIC or other integrated circuit, a digital signal processor, a hardwire electronic or logic circuit such as discrete element circuit, a programmable logic device such as PLD, PLA, FPGA or PAL, or the like. In general, any device capable of implementing a finite state machine that is in turn capable of implementing the communication system 100 of FIG. 6, any of the devices of FIGS. 7 and 8, or the flowchart of FIG. 9 can be used to implement the transmitter 110 and/or receiver 140.

It should be similarly understood that each of the components and circuits shown in FIGS. 6-8 can be implemented as distinct optical devices. Alternatively, each of the optical components and circuits shown in FIGS. 6-8 can be implemented as physically indistinct or shared hardware or combined with other components and circuits otherwise not related to the devices of FIGS. 6-8 and the flowchart of FIG. 9. The particular form each optical component and circuit shown in FIGS. 6-8 will take is a design choice and will be obvious and predictable to those skilled in the art.

While this invention has been described in conjunction with the specific embodiments thereof, it is evident that many alternatives, modifications, and variations will be apparent to those skilled in the art. Accordingly, preferred embodiments of the invention as set forth herein are intended to be illustrative and not limiting. Thus, there are changes that may be made without departing from the spirit and scope of the invention.

What is claimed is:

1. A computing device for processing speech, the computing device comprising:

a module configured to synthesize a first filter having at least one pseudo-cepstral coefficient based on a set of linear predictive coding coefficients; and a module configured to process one or more frames of speech using the first filter.

2. The computing device of claim 1, wherein a pseudo-cepstral coefficient is a parameter relating to a pseudo-cepstrum domain existing between the linear predictive coding domain and the line spectral frequency domain.

3. The computing device of claim 1, wherein the first filter emphasizes speech frequency components related to at least one formant based on the set of linear predictive coding coefficients and de-emphasizes speech frequency components related to at least one spectral valley based on the set of linear predictive coding coefficients.

4. The computing device of claim 3, wherein the first filter compensates for spectral tilt.

5. The computing device of claim 3, wherein the one or more pseudo-cepstral coefficients are derived based on the formula:

$$H_S(z) \cong (P_M(z/\alpha_1)Q_M(z/\alpha_2))/A_M^2(z/\beta),$$

wherein $P_M(z)=A_M(z)+z^{-(M+1)}A_M(z^{-1})$, $Q_M(z)=A_M(z)-z^{-(M+1)}A_M(z^{-1})$ and $\alpha 1$, $\alpha 2$ and $\beta$ are control parameters, and wherein $A_M(z)$ relates to a linear predictive coding transfer function and M is the order of the linear predictive coding transfer function.

6. The computing device of claim 5, wherein $0<\alpha_1$, $0<\alpha_2$ and $\beta<1.0$.

7. The computing device of claim 6, wherein $\alpha_1+\alpha_2=2\beta$.

8. The computing device of claim 5, wherein $\alpha_1+\alpha_2=\beta$.

9. The computing device of claim 5, wherein $0<\alpha_1$, $0<\alpha_2$ and $\beta<0.5$.

10. The computing device of claim 3, wherein the one or more pseudo-cepstral coefficients are derived based on the formula:

$$H_S(z) \cong (P_M(z/\alpha_1)Q_M(z/\alpha_2))/A_M(z/2\beta),$$

wherein $P_M(z)=A_M(z)+z^{-(M+1)}A_M(z^{-1})$, $Q_M(z)=A_M(z)-z^{-(M+1)}A_M(z^{-1})$ and $\alpha_1$, $\alpha_2$ and $\beta$ are control parameters, and wherein $A_M(z)$ relates to a linear predictive coding transfer function and M is the order of the linear predictive coding transfer function.

11. The computing device of claim 3, wherein the one or more pseudo-cepstral coefficients are derived based on the formula:

$$HmS(z) \cong (Pm(z/\alpha 1)Qm(z/\alpha 2))/AM(z/2\beta),$$

wherein $\alpha 1$, $\alpha 2$ and $\beta$ are control parameters, Pm(z)=Am(z)+z−(m+1)Am(z−1), Qm(z)=Am(z)−z−(m+1)Am(z−1), and wherein AM(z) relates to a linear predictive coding transfer function and M is the order of the linear predictive coding transfer function, and wherein $A_m(z)$ is a second linear predictive coding transfer function based on $A_M(z)$, m is the order of $A_m(z)$ and $1 \leqq m \leqq M$.

12. The computing device of claim 11, wherein $0<\alpha_1$, $0<\alpha_2$ and $\beta<0.5$.

13. The computing device of claim 11, wherein $\alpha_l+\alpha_2=2\beta$.

14. A computer readable medium storing instructions for controlling a computing device for processing speech, the instructions comprising:

synthesizing a first filter having at least one pseudo-cepstral coefficient based on a set of linear predictive coding coefficients; and processing one or more frames of speech using the first filter.

15. The computer readable medium of claim 14, wherein a pseudo-cepstral coefficient is a parameter relating to a pseudo-cepstrum domain existing between the linear predictive coding domain and the line spectral frequency domain.

16. The computer readable medium of claim 14, wherein the first filter emphasizes speech frequency components related to at least one formant based on the set of linear predictive coding coefficients and de-emphasizes speech frequency components related to at least one spectral valley based on the set of linear predictive coding coefficients.

17. The computer readable medium of claim 16, wherein the first filter compensates for spectral tilt.

18. The computer readable medium of claim 16, wherein the one or more pseudo-cepstral coefficients are derived based on the formula:

$$H_S(z) \cong (P_M(z/\alpha_1)Q_M(z/\alpha 2))/A_M^2(z/\beta),$$

wherein $P_M(z)=A_M(z)+z^{-(M+1)}A_M(z^{-1})$, $Q_M(Z)=A_M(z)-z^{-(M+1)}A_M(z^{-1})$ and $\alpha_1$, $\alpha_2$ and $\beta$ are control parameters, and wherein $A_M(z)$ relates to a linear predictive coding transfer function and M is the order of the linear predictive coding transfer function.

19. The computer readable medium of claim 18, wherein $0<\alpha_1$, $0<\alpha_2$ and $\beta<1.0$.

20. The computer readable medium of claim 18, wherein $\alpha_1+\alpha_2=\beta$.

21. The computer readable medium of claim 16, wherein the one or more pseudo-cepstral coefficients are derived based on the formula:

$$H_S(z) \cong (P_M(z/\alpha_1)Q_M(z/\alpha_2))/A_M(z/2\beta),$$

wherein $P_M(z)=A_M(z)+z^{-(M+1)}A_M(z^{-1})$, $Q_M(z)=A_M(z)-z^{-(M+1)}A_M(z^{-1})$ and $\alpha_1$, $\alpha_2$ and $\beta$ are control parameters, and wherein $A_M(z)$ relates to a linear predictive coding transfer function and M is the order of the linear predictive coding transfer function.

22. The computer readable medium of claim 18, wherein $0<\alpha_1$, $0<\alpha_2$ and $\beta<0.5$.

23. The computer readable medium of claim 18, wherein $\alpha_l+\alpha_2=2\beta$.

24. The computer readable medium of claim 16, wherein the one or more pseudo-cepstral coefficients are derived based on the formula:

$$HmS(z) \cong (Pm(z/\alpha 1)Qm(z/\alpha 2))/AM(z/2\beta),$$

wherein $\alpha 1$, $\alpha 2$ and $\beta$ are control parameters, Pm(z)=Am(z)+z−(m+1)Am(z−1), Qm(z)=Am(z)−z−(m+1) Am(z−1), and wherein AM(z) relates to a linear predictive coding transfer function and M is the order of the linear predictive coding transfer function, and wherein $A_m(z)$ is a second linear predictive coding transfer function based on $A_M(z)$, m is the order of $A_m(z)$ and $1 \leqq m \leqq M$.

25. The computer readable medium of claim 24, wherein $0<\alpha_1$, $0<\alpha_2$ and $\beta<0.5$.

26. The computer readable medium of claim 24, wherein $\alpha_1+\alpha_2=2\beta$.

* * * * *